US010384334B2

(12) United States Patent
Tsai et al.

(10) Patent No.: US 10,384,334 B2
(45) Date of Patent: Aug. 20, 2019

(54) RATCHET SCREWDRIVER

(71) Applicants: Chiung-Chang Tsai, Taichung (TW); Chung-Yu Tsai, Taichung (TW)

(72) Inventors: Chiung-Chang Tsai, Taichung (TW); Chung-Yu Tsai, Taichung (TW)

( * ) Notice: Subject to any disclaimer, the term of this patent is extended or adjusted under 35 U.S.C. 154(b) by 34 days.

(21) Appl. No.: 15/721,737

(22) Filed: Sep. 30, 2017

(65) Prior Publication Data

US 2019/0099864 A1 Apr. 4, 2019

(51) Int. Cl.

*B25B 13/46* (2006.01)
*B25B 23/00* (2006.01)
*B25B 15/04* (2006.01)

(52) U.S. Cl.

CPC ..... *B25B 13/463* (2013.01); *B25B 13/468* (2013.01); *B25B 15/04* (2013.01); *B25B 23/0007* (2013.01); *B25B 13/465* (2013.01); *B25B 13/467* (2013.01)

(58) Field of Classification Search

CPC ..... B25B 13/463; B25B 13/468; B25B 15/04; B25B 23/0007; B25B 13/467; B25B 23/0035; B25B 13/465

See application file for complete search history.

(56) References Cited

U.S. PATENT DOCUMENTS 6,925,912 B2 * 8/2005 Huang ..... B25B 13/463 192/43.2
7,380,482 B1 * 6/2008 Chan ..... B25B 13/465 192/43.2
7,413,065 B2 * 8/2008 Gauthier ..... B25B 13/463 192/43.1
7,926,391 B2 * 4/2011 Hu ..... B25B 15/04 81/436
8,210,074 B2 * 7/2012 Wang ..... B25B 13/465 81/63.1
8,931,375 B2 * 1/2015 Huang ..... B25B 13/463 81/63.1
9,278,435 B2 * 3/2016 Tsai ..... B25B 13/463
9,931,739 B2 * 4/2018 Nelson ..... B25B 15/04
9,969,066 B2 * 5/2018 Li ..... B25B 15/04
2002/0170392 A1 * 11/2002 Chen ..... B25B 13/466 81/58.3
2006/0096422 A1 * 5/2006 Huang ..... B25B 13/465 81/63.1
2007/0240544 A1 * 10/2007 Hu ..... B25B 15/04 81/63.1
2012/0055290 A1 * 3/2012 Chen ..... B25B 13/463 81/63.1

* cited by examiner

*Primary Examiner* — Monica S Carter
*Assistant Examiner* — Danny Hong

(57) ABSTRACT

A ratchet screwdriver includes a mounting seat, a control member, a driving shaft, two pawls and two springs. The mounting seat has a receiving space, a first slot and a second slot. A passage is defined through the mounting seat. The first and second slots have a hole respectively. The driving shaft has a ratchet portion located in the receiving space. Each pawl is biased by one spring so as to be engaged with the ratchet portion. The control member is rotatably mounted to the mounting seat and the driving shaft. The control member has two control plates to pivot the pawls to disengage from the ratchet portion of the driving shaft.

11 Claims, 9 Drawing Sheets

RATCHET SCREWDRIVER

FIELD OF THE INVENTION

The present invention relates to a screwdriver, and more particularly, to a ratchet driving device for a ratchet screwdriver.

BACKGROUND OF THE INVENTION

U.S. Pat. No. 9,278,435 is one previous invention of the present inventors', which discloses and comprises a mounting seat 10, a driving shaft 20, four pawls 30, four springs 40, a fixing ring 50, a control member 60, a bead 70, a positioning spring 71, a C-clip 80 and a clipping member 81. The rear side of the mounting seat 10 is connected with a handle (not shown) and has a space 11 defined in the front side thereof. Two first slot 112 and two second slots 113 are defined in the inside of the space 11. Each of the first slots 111 has a first hole 112 and each of the second slots 113 has a second hole 114. A passage 12 is defined through the mounting seat 10 and has a smaller diameter. A reception hole 13 is defined in the wall of the mounting seat 10. The mounting seat 10 has two fixing members 14 and four fixing slots 15 defined in the front side thereof. A block 16 extends from the outside of the mounting seat 10 and located in opposite to the reception hole 13. The driving shaft 20 has a ratchet portion 21 with multiple teeth. A section 22 extends from the rear end of the driving shaft 20 and is rotatably inserted through the passage 12. A working end 24 of the driving shaft 20 has a polygonal recess to be connected with a driving member. Four pawls 30 are respectively located in the first and second slots 111, 113, and each pawl 30 has a bottom insertion 31 and a top insertion 32 extending from two ends of one side thereof. The bottom insertions 31 of the pawls 30 in the first slots 111 and second slots 113 are pivotably inserted into the first holes 112 and second holes 114 respectively so that each of the pawls 30 is pivotable to engage one of the concavities of the ratchet portion 21. Therefore, the driving shaft 20 is driven to rotate counter clockwise or clockwise by rotating the mounting seat 10 by the engagement between the pawls 30 in the first slots 111 or second slots 113 and the ratchet portion 21. Four springs 40 provide a force to pivot the pawls 30 respectively to engage with the ratchet portion 21. By the force from the springs 40, the four pawls 30 are pivoted and engaged with the concavities of the ratchet portion 21. When the driving shaft 20 is rotated counter clockwise or clockwise, the teeth of the ratchet portion 21 drive the pawls 30 in the first slots 111 or second slots 113 to compress the springs 40 on respective insides of the pawls 30 so that the driving shaft 20 is freely rotated. The fixing ring 50 is a ring-shaped member and is connected to the front side of the mounting seat 10, and has four through holes 51, two apertures 52 and four protrusions 53. The top insertions 32 of the four pawls 30 are pivotably inserted into the four through holes 51. The two fixing members 14 are inserted into the two apertures 52. The four protrusions 53 are engaged with the four fixing slots 15. The control member 60 is rotatably mounted to the mounting seat 10 and has a mounting hole 61 for the driving shaft 20 rotatably extending through. Two control plates 62 symmetrically extend from the inner periphery of the mounting hole 61. When the control member 60 is rotated clockwise or clockwise, the control plates 62 pivot the two pawls 30 in the second slots 113 or first slots 111 to compress the springs 40 and remove the two pawls 30 from the concavities of the ratchet portion 21, so that the driving shaft 20 is freely rotated counter clockwise or clockwise relative to the mounting seat 10. The C-clip 80 and clipping member 81 are engaged with the groove 23 and annular slot 25 of the driving shaft 20 respectively to restrict the control member 60 from being separated from the front side of the mounting seat 10.

The disadvantages of the above-mentioned previous patent are: 1) the two pawls 30 are pivoted in the first slots 111 and second slots 113 by bottom insertion 31 and top insertion 32 inserting in the first hole 112 and second hole 114 respectively so as to be pivotable to engage with the ratchet portion 21, but the pawl 30 only use their distal ends to engage one concavity between two teeth of the ratchet portion 21, so the drive torque is very lower; and 2) the bottom insertion 31 and top insertion 32 of the pawls 30 are in plate shape, so that they are unstable when insert in the first hole 112 and second hole 114.

The present invention intends to provide a ratchet driving device for a ratchet screwdriver to improve the shortcomings of the prior arts mentioned above.

SUMMARY OF THE INVENTION

The present invention relates to a ratchet screwdriver and comprises a mounting seat, a fixing ring, a control member, a driving shaft, two pawls, two springs, a fixing ring, a control member, a bead, a positioning spring, a C-clip and a clipping member. The mounting seat has a receiving space, a first slot and a second slot. A passage is defined through the mounting seat. The first and second slots have a hole respectively. The driving shaft has a ratchet portion located in the receiving space. Each pawl is biased by one spring so as to be engaged with the ratchet portion. The control member is rotatably mounted to the mounting seat and the driving shaft. The control member has two control plates to pivot the pawls to disengage from the ratchet portion of the driving shaft.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
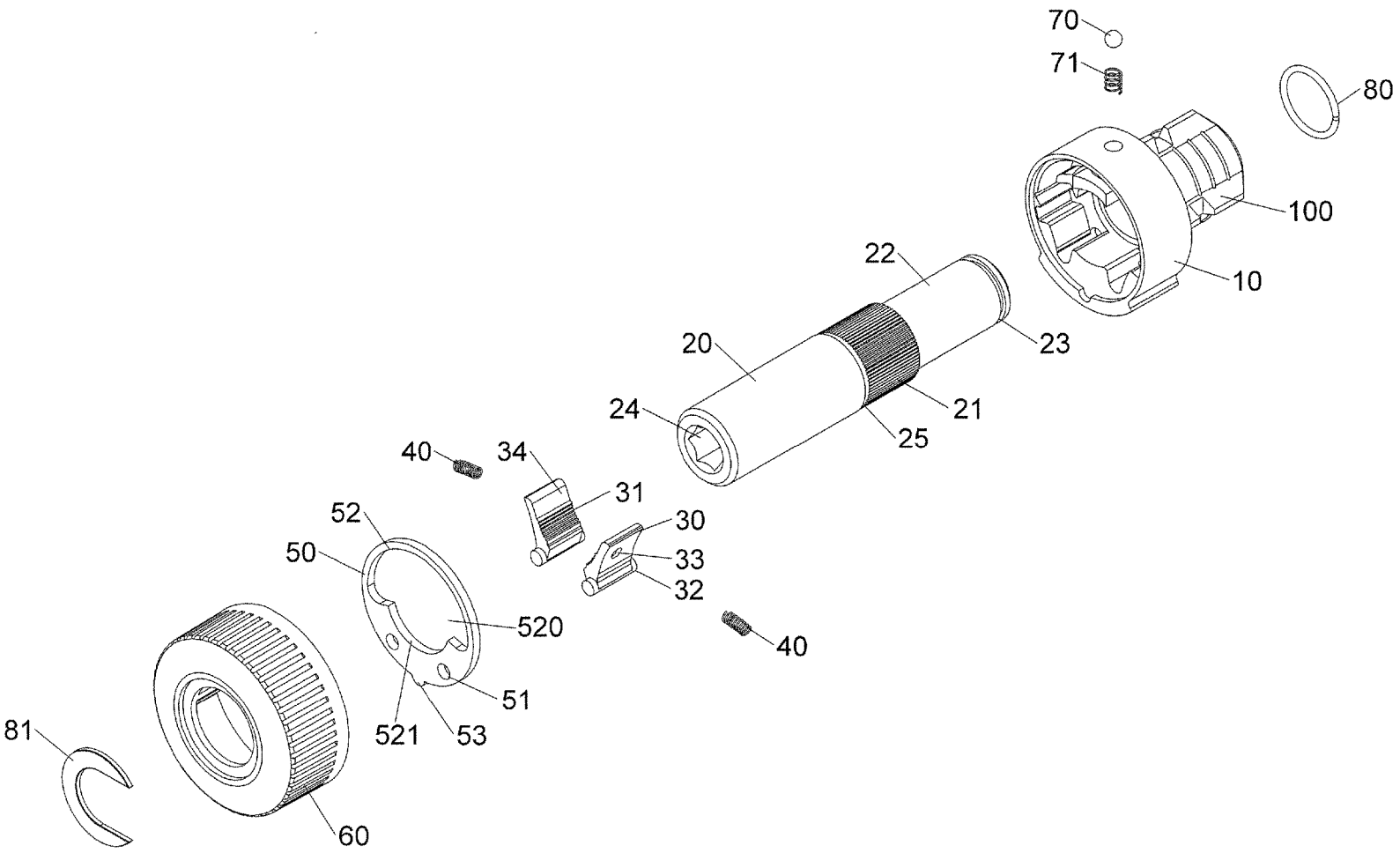
FIG. 1 is an exploded view of the ratchet screwdriver of the present invention.
Figure 3:
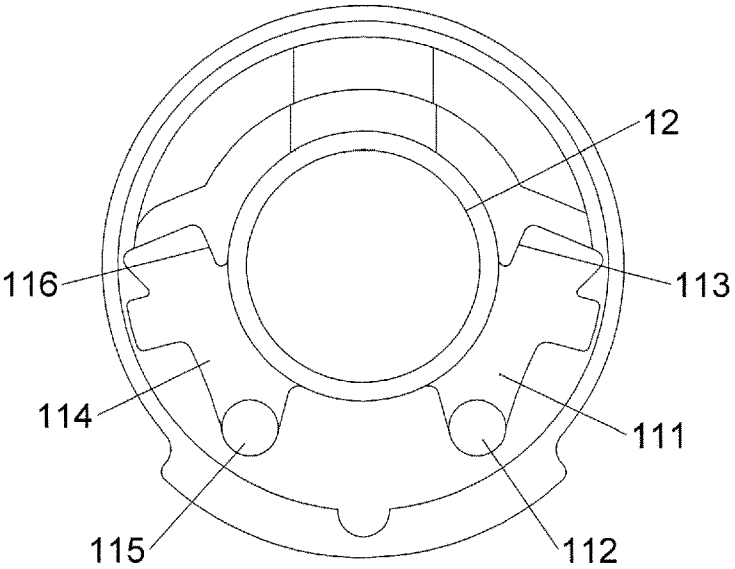
FIG. 3 is a plane view to show the front side of the mounting seat of the ratchet screwdriver of the present invention.
Figure 2:
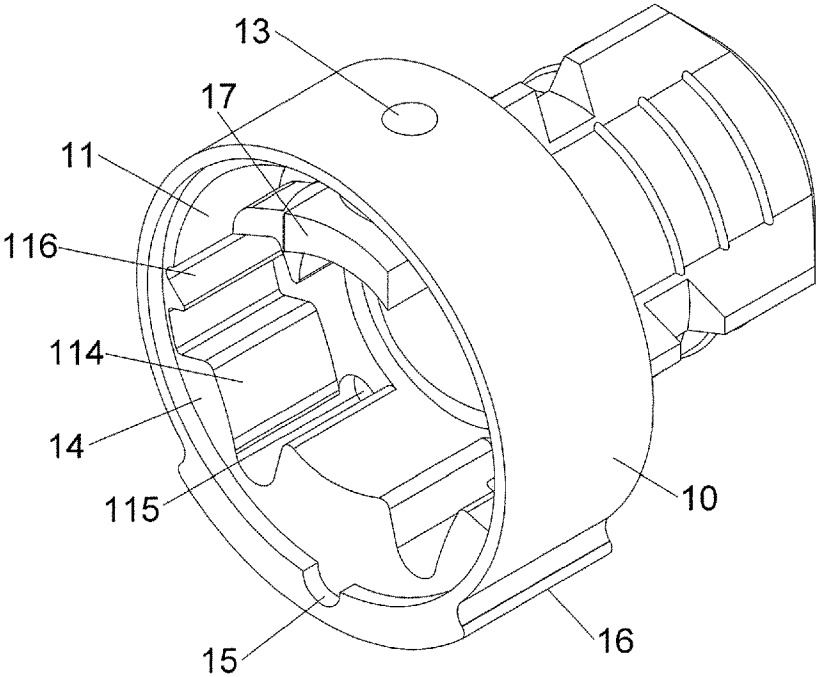
FIG. 2 is a perspective view to show the mounting seat of the ratchet screwdriver of the present invention.
Figure 5:
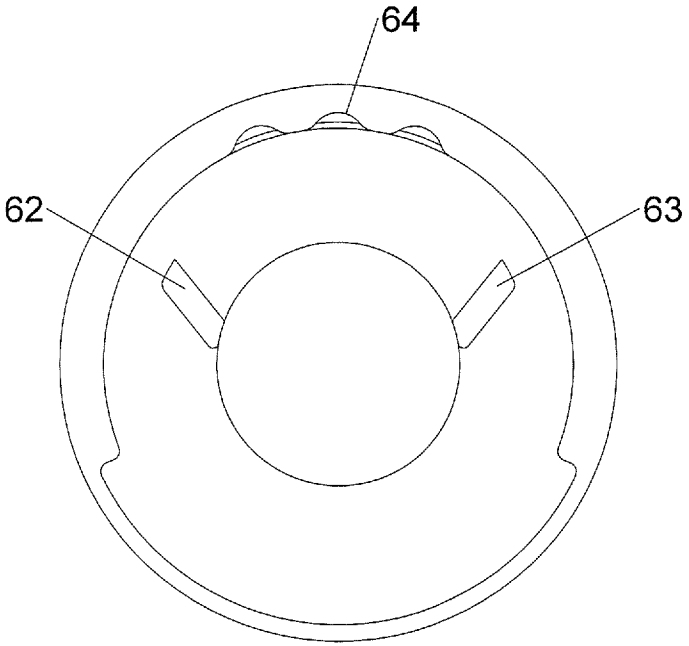
FIG. 5 is a plane view to show the lateral side of the control member of the ratchet screwdriver of the present invention.
Figure 4:
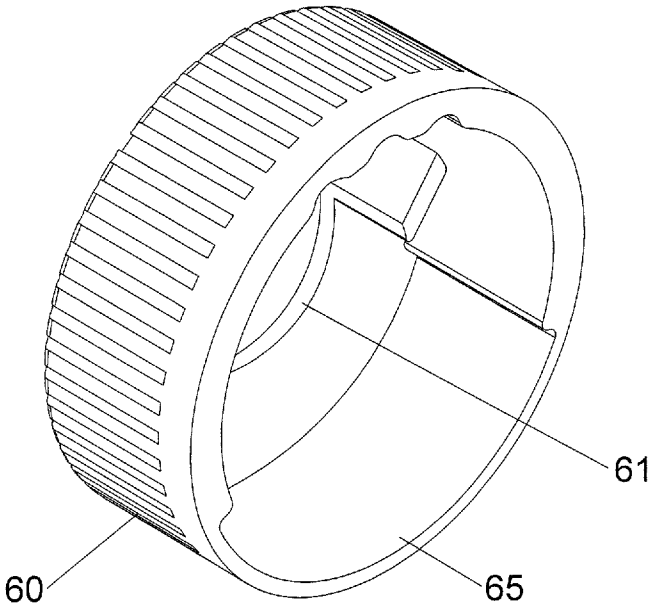
FIG. 4 is a perspective view to show the rear side of the control member of the ratchet screwdriver of the present invention.
Figure 6:
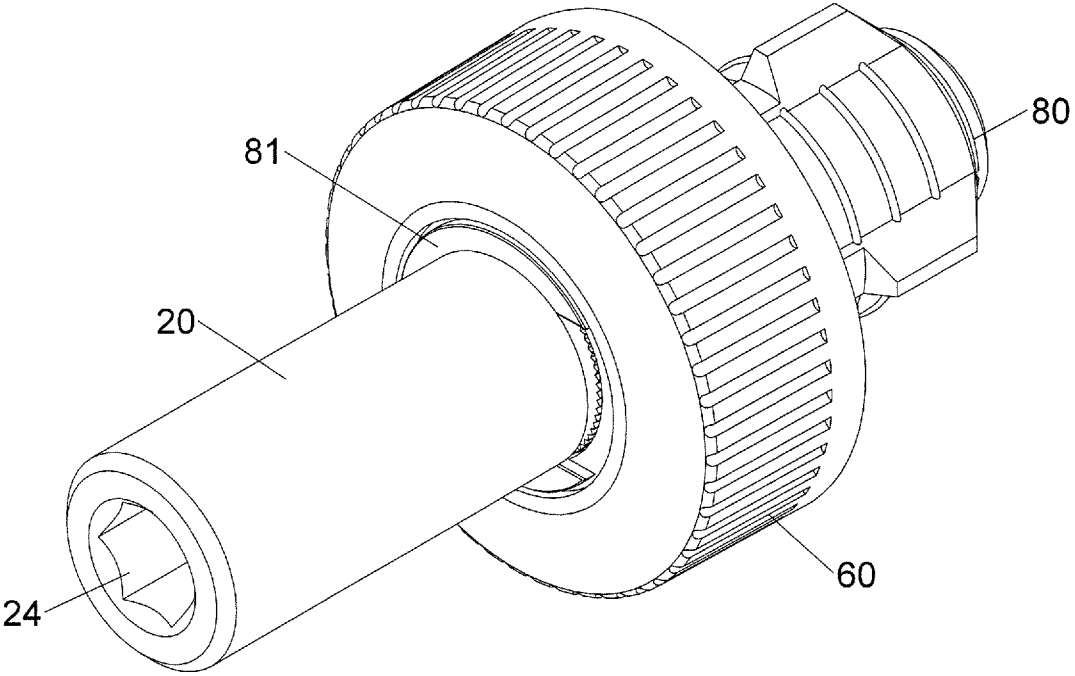
FIG. 6 is a perspective view to show the ratchet screwdriver of the present invention.

Referring to FIGS. 1 to 8, the ratchet screwdriver of the present invention comprises a mounting seat 10, a driving shaft 20, two pawls 30, two springs 40, a fixing ring 50, a control member 60, a bead 70, a positioning spring 71, a C-clip 80 and a clipping member 81. The end portion 100 of the rear side of the mounting seat 10 is connected with a handle (not shown). The mounting seat 10 has a receiving space 11 defined in the front side thereof. A first slot 111 and a second slot 114 are defined in the inside of the receiving space 11. Opposite a first arc protrusion 17 and a second arc protrusion 18 are defined in the inside of the receiving space 11 and have same diameter smaller than that of the receiving space 11. The first arc protrusion 17 has a distal end directing to the front side of the mounting seat 10. The first and second slots 111, 114 are located symmetrically in opposite directions to each other. The first slot 111 has a first hole 112 defined in the inner portion thereof, and the second slot 114 has a second hole 115 defined in the inner portion thereof. A first limit portion 113 with an inclined face is defined on a lateral side of the first slot 111. A second limit portion 116 with an inclined face is defined on a lateral side of the second slot 114. The first and second holes 112, 115 are located symmetrically in opposite directions to each other. The first and second limit portions 113, 116 are located symmetrically in opposite directions to each other. A passage 12 is defined through the mounting seat 10 and has a smaller diameter, and is coaxially connected with the receiving space 11. A receiving hole 14 is defined at the front open end of the receiving space 11 and has a larger diameter than that of the receiving space 11. One side of an inner wall of the receiving hole 14 is defined a recessed arc fixing hole 15. A reception hole 13 is defined in the wall of the mounting seat 10. A block 16 extends from the outside of the mounting seat 10 and located in opposite to the reception hole 13.

A middle portion of the driving shaft 20 has a ratchet portion 21 which has a larger outer diameter and is located in the receiving space 11, so that one end of the ratchet portion 21 contacts the bottom of the receiving space 11. The ratchet portion 21 is hold by the opposite first arc protrusion 17 and second arc protrusion 18. The ratchet portion 21 has multiple teeth and concavities which are located alternatively to the teeth. A section 22 with a smaller diameter extends from the rear end of the driving shaft 20 and is rotatably inserted through the passage 12. A circular groove 23 is defined in the outer periphery of the rear end of the driving shaft 20 and located beyond the mounting seat 10. A working end 24 is formed on the front end of the driving shaft 20 and has a polygonal recess such as a rectangular recess or a hexagonal recess, so as to be connected with a driving member, a bolt, a nut, a socket or a connection rod. An annular slot 25 is defined in the outer periphery of the driving shaft 20.

Two pawls 30 are respectively located in the first and second slots 111, 114 and are located symmetrically in opposite directions to each other with respect to the mounting sear 10. Each pawl 30 has opposite a first lateral portion and a second lateral portion, and has opposite a left lateral side and a right lateral side. A middle portion of a left lateral side of each pawl 30 has a circular recessed connecting portion 33. A middle portion of a right lateral side of each pawl 30 has an engaging portion 31 with multiple teeth for engaging with the teeth of the ratchet portion 21. The first lateral portion of each pawl 30 has a cylindrical pivot 32 with two ends protruding the front end and the rear end of each pawl 30. The second lateral portion of each pawl 30 has a contact portion 34. The pivots 32 of the pawls 30 in the first and second slots 111, 114 are respectively pivotably inserted into the first and second holes 112, 115, so that the two pawls 30 are rotatable to engage with the teeth of the ratchet portion 21 by their teeth. Therefore, the driving shaft 20 is driven to rotate counter clockwise by rotating the mounting seat 10 by the engagement between the teeth of the pawls 30 in the first and second slots 111, 114 and the teeth of the ratchet portion 21 of the driving shaft 20.

Two springs 40 are respectively located in the first and second slots 111, 114 and provide elastic forces to pivot the two pawls 30 to engage with the teeth of the ratchet portion 21 by the teeth of their engaging portions 31. The spring 40 in the first slot 111 is biased between the inside of the first slot 111 and the recessed connecting portion 33 of the pawl 30 corresponding thereto, and the spring 40 in the second slot 114 is biased between the inside of the second slot 114 and the recessed connecting portion 33 of the pawl 30 corresponding thereto. By the force from the springs 40, the teeth of the engaging portions 31 of the two pawls 30 are pivoted and engaged with the teeth of the ratchet portion 21.

When the driving shaft 20 is rotated counter clockwise, the teeth of the ratchet portion 21 drive the pawl 30 in the first slot 111 to compress the spring 40 on respective inside of the pawl 30 so that the driving shaft 20 is freely rotated with respect to the pawl 30 in the first slot 111. When the driving shaft 20 is rotated clockwise, the teeth of the ratchet portion 21 drive the pawl 30 in the second slot 114 to compress the spring 40 on respective inside of the pawl 30, so that the driving shaft 20 is freely rotated with respect to the pawl 30 in the second slot 114.

The fixing ring 50 is a ring-shaped member having one through hole 52, two apertures 51 and one arc protrusion 53. The inner periphery of the through hole 52 is shaped by a connection of a bigger half circular hole 520 and a smaller half circular hole 521. The fixing ring 50 is connected to the front side of the mounting seat 10 and is fixedly mounted in the receiving hole 14. The pivots 32 of the two pawls 30 are pivotably inserted into the two apertures 51. The protrusion 53 is engaged with the fixing hole 15, so that the fixing ring 50 can't rotate with respect to the mounting seat 10.

The control member 60 is rotatably mounted to the mounting seat 10 and has a mounting hole 61 defined therethrough. The driving shaft 20 rotatably extends through the receiving space 11, the passage 12, the smaller half circular hole 521 of the through hole 52 and the mounting hole 61. Two control plates 62, 63 symmetrically extend from the inner periphery of the mounting hole 61, and distal portions of the two control plates 62, 63 insert into the bigger half circular hole 520 of the through hole 52 of the fixing ring 50. When the control member 60 is rotated clockwise with respect to the mounting seat 10, the control plate 62 pivot one pawl 30 in the first slot 111 to compress the spring 40 and remove the teeth of the pawl 30 in the first slot 111 from the teeth of the ratchet portion 21, so that the driving shaft 20 is freely rotated clockwise relative to the mounting seat 10.

Two opposite inner sides of the control member 60 respectively have three positioning slots 64 and a restriction slot 65 defined therein. The block 16 is movable in the restriction slot 65. When the control member 60 is rotated counter clockwise with respect to the mounting seat 10 and from a second position to a first position, and the block 16 contacts one end of the restriction slot 65, one control plate 63 pivot the pawl 30 in the second slot 114 to compress the spring 40 and remove the teeth of one pawl 30 in the second slot 114 from the teeth of the ratchet portion 21, so that the driving shaft 20 is freely rotated counter clockwise relative to the mounting seat 10. When the control member 60 is rotated clockwise with respect to the mounting seat 10 and from the second position to a third position, and the block 16 contacts another end of the restriction slot 65, the control plate 62 removes the teeth of the pawl 30 in the first slot 111 from the teeth of the ratchet portion 21, so that the driving shaft 20 is freely rotated clockwise relative to the mounting seat 10. When the control member 60 is at the second position with respect to the mounting seat 10, the teeth of the two pawls 30 engage with the teeth of the ratchet portion 21, so that the driving shaft 20 is rotatable clockwise and counter clockwise together with the mounting seat 10. The bead 70 is axially and movably located in the reception hole 13. The positioning spring 71 is located in the reception hole 13 and biases the bead 70 outward to be engaged with one of the three positioning slots 64, so as to position the control member 60 at a first position where the driving shaft 20 is freely rotated counter clockwise, a second position where the driving shaft 20 cannot rotate freely, and a third position where the driving shaft 20 is freely rotated clockwise.

The C-clip 80 is engaged with the groove 23 of the driving shaft 20 and restricts the driving shaft 20 from being separated from the front side of the mounting seat 10. The clipping member 81 is engaged with the annular slot 25 of the driving shaft 20 to restrict the control member 60 from being separated from the front side of the mounting seat 10.

Figure 8:
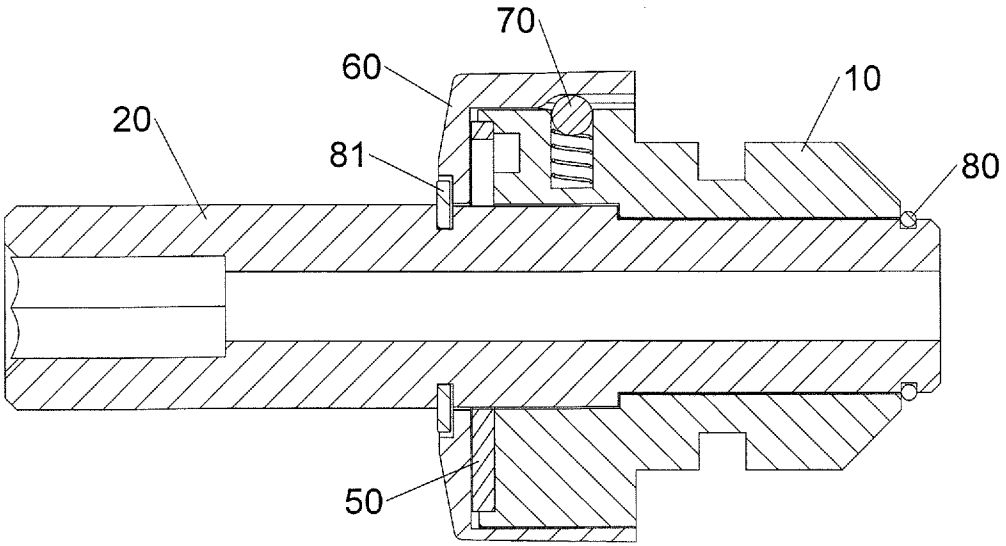
FIG. 8 is a cross sectional view taken along line 8-8 in FIG. 7.
Figure 7:
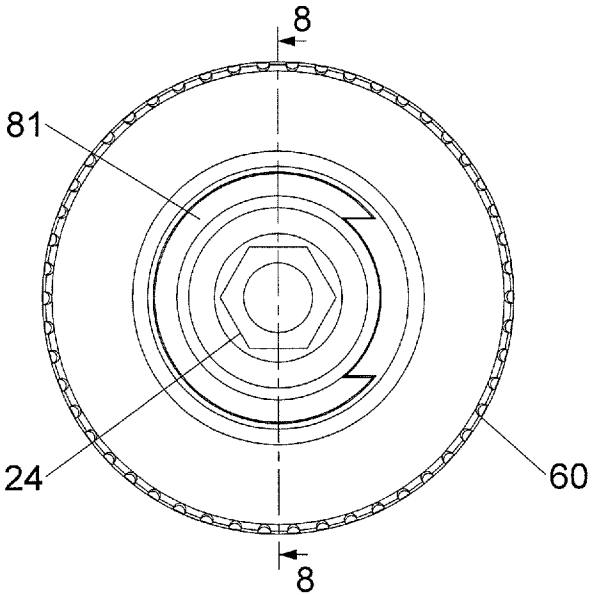
FIG. 7 is a front end view of the ratchet screwdriver of the present invention.

As shown in FIGS. 7 and 8, when the control member 60 is rotated clockwise relative to the mounting seat 10 and to the third position, and the block 16 moves and contacts one end of the restriction slot 65, the bead 70 is engaged with one of the three positioning slot 64 to position the control member 60, and the control plate 62 remove the teeth of the pawl 30 in the first slot 111 from the teeth of the ratchet portion 21. Therefore, when the mounting seat 10 is rotated counter clockwise, the pawl 30 in the second slot 114 drive the driving shaft 20 to rotate counter clockwise, and when the mounting seat 10 is rotated clockwise, the driving shaft 20 is freely rotated in the mounting seat 10.

Figure 9:
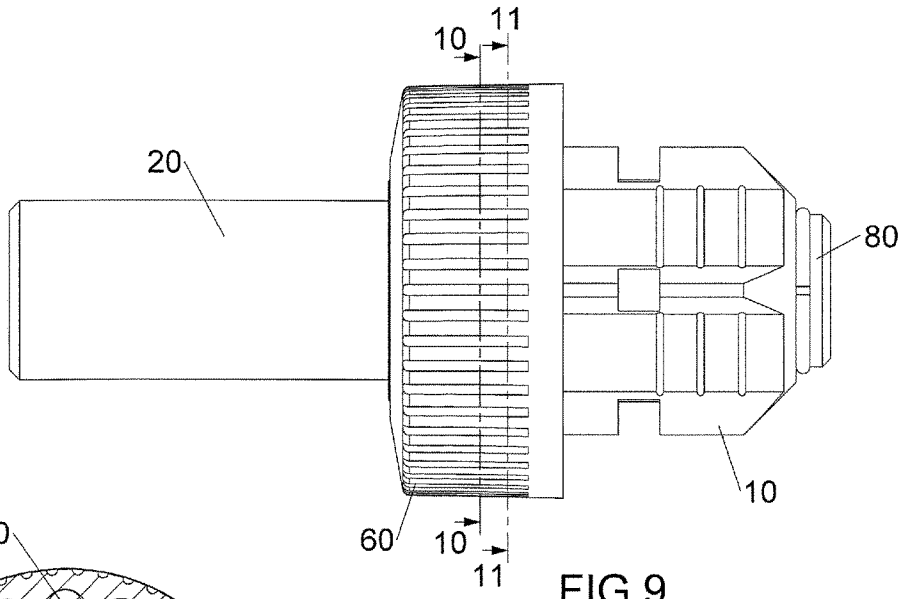
FIG. 9 is a side view of the ratchet screwdriver of the present invention.
Figure 10:
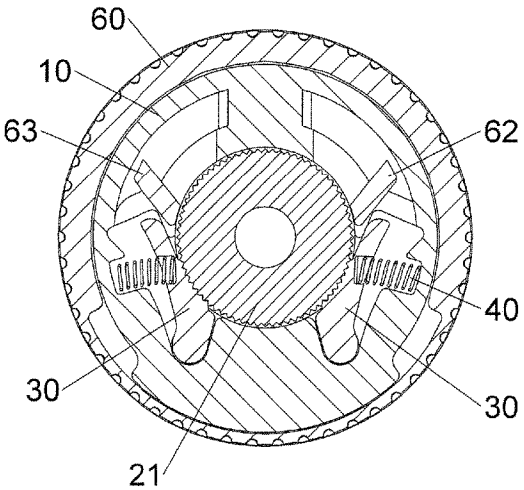
FIG. 10 is a cross sectional view taken along line 10-10 in FIG. 9.
Figure 11:
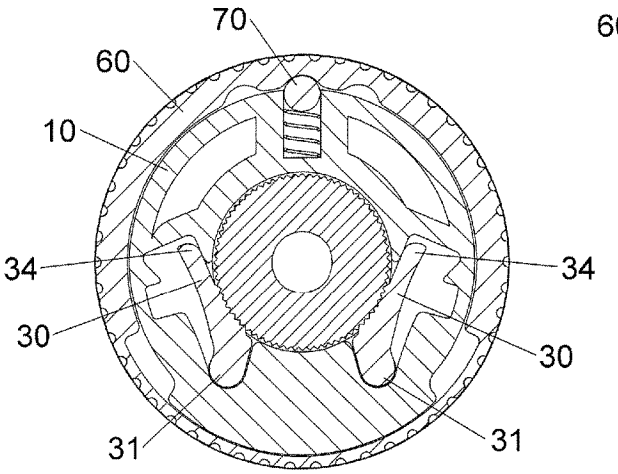
FIG. 11 is a cross sectional view taken along line 11-11 in FIG. 9.

As shown in FIGS. 9 to 11, the two pawls 30 are positioned in the first and second slots 111, 114 respectively, and the contact portions 34 of the two pawls 30 contact with the first and second limit portions 113, 116 of the first and second slots 111, 114 respectively. when the control member 60 is rotated relative to the mounting seat 10 and to the second position, and to let the bead 70 engaged with central one of the three positioning slot 64, the two ends of the two control plates 62 do not pivot the two pawls 30 so that the two pawls 30 are biased by the two springs 40 and pivoted to be engaged with the teeth of the ratchet portion 21 by their teeth of engaging portion 31. Therefore, when the mounting seat 10 is rotated clockwise, the two pawls 30 in the first and second slots 111, 114 drive the driving shaft 20 to rotate clockwise, and when the mounting seat 10 is rotated counter clockwise, the driving shaft 20 is rotated in counter clockwise by the two pawls 30 in the first and second slots 111, 114.

Figure 12:
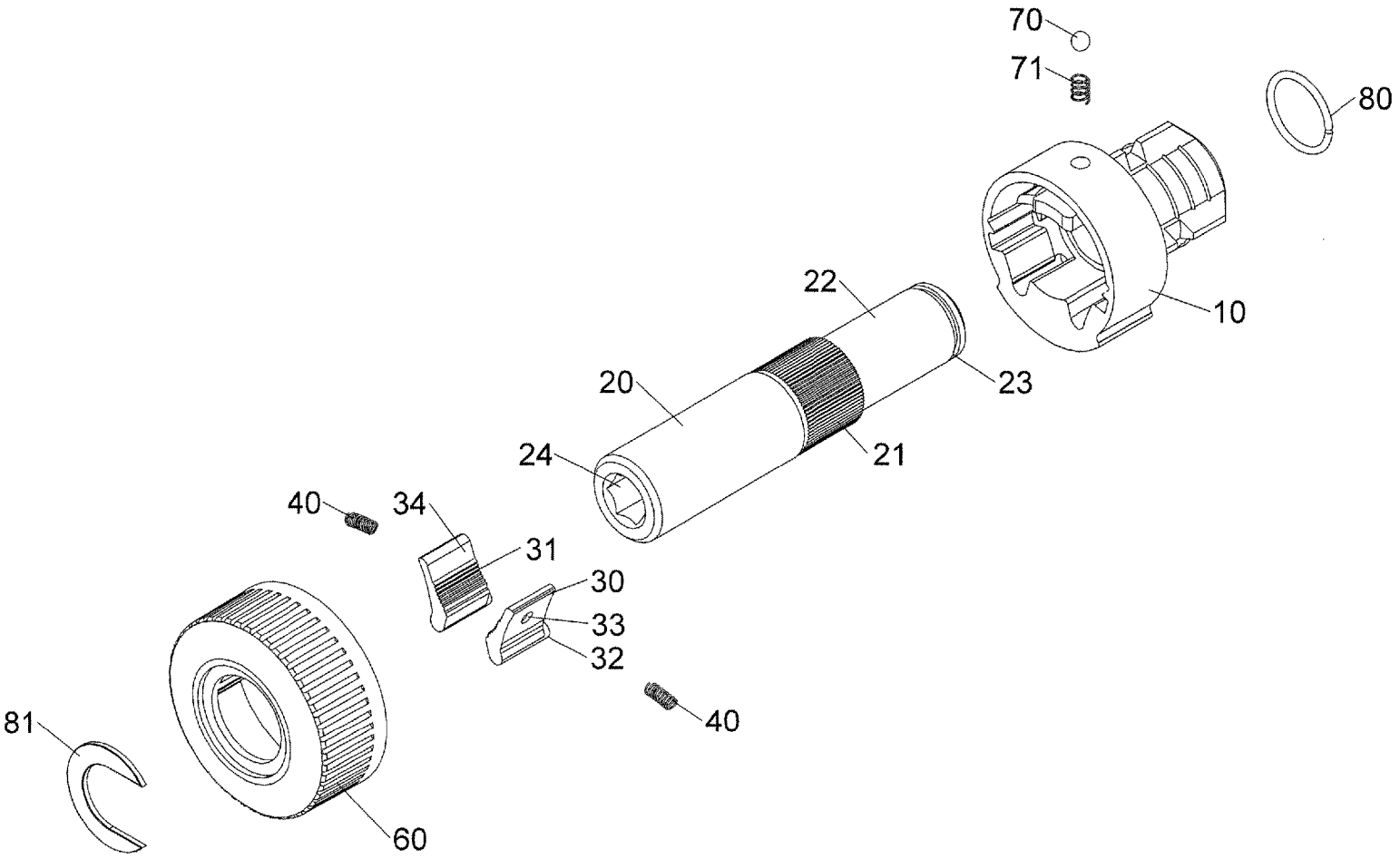
FIG. 12 shows a second embodiment of the ratchet screwdriver of the present invention.

As shown in FIG. 12 which shows the second embodiment of the present invention wherein the mounting seat 10 has no the receiving hole 14 and fixing hole 15, and there is no the fix ring 50.

Figure 13:
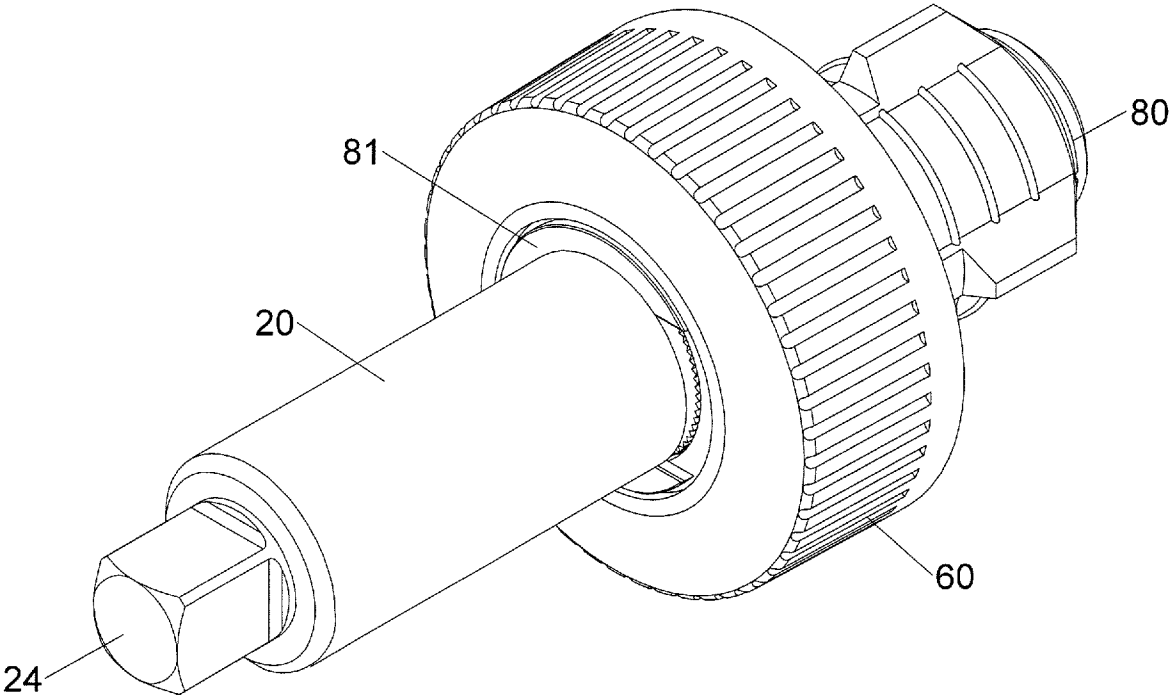
FIG. 13 shows a third embodiment of the ratchet screwdriver of the present invention.

As shown in FIG. 13 which shows the third embodiment of the present invention wherein the difference is that the working end 24 of the driving shaft 20 has a polygonal rod which can be connected with a socket or a bolt, or a threaded member connected with a rectangular rod or hexagonal rod.

Figure 14:
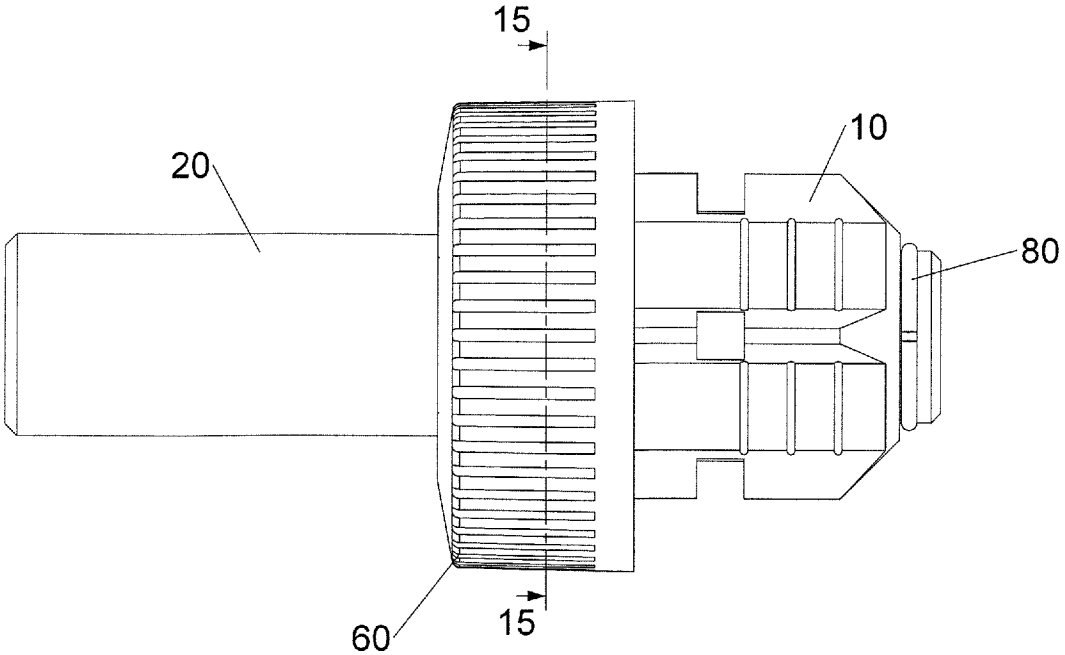
FIG. 14 shows a fourth embodiment of the ratchet screwdriver of the present invention.
Figure 15:
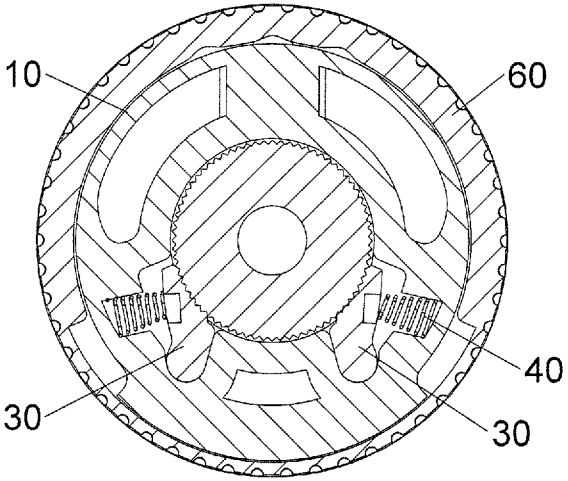
FIG. 15 is a cross sectional view taken along line 15-15 in FIG. 14.

As shown in FIGS. 14 and 15 which show the fourth embodiment of the present invention wherein the mounting seat 10 has no the first and second limit portions 113, 116, and the two pawls 30 have no the contact portions 34.

The advantages of the present invention are as followings:

1. the two pawls 30 received in the first and second slots 111, 114 each is pressed by an elastic force of one spring 40 and has an engaging portions 31 with multiple teeth at lateral side, so that the engaging portions 31 engage with the ratchet portion 21 by multiple teeth, and so that the screwdriver has more effective driving torque;

2. the two pawls 30 have cylindrical pivots 32 pivotably inserted into the first and second holes 112, 115, and apertures 51 of the fixing ring 50, so that the two pawls 30, the fixing ring 50 and the mounting seat 10 are mounted stably; and 3. the outer diameter of the driving shaft 20 is equal to or smaller with a tolerance no larger than 0.05 mm with respect to the inner diameter of the passage 12, the smaller half circular hole 521 and the mounting hole 61, so that the driving shaft 20 is supported stably by the mounting seat 10, the fixing ring 50 and the control member 60.

While we have shown and described the embodiment in accordance with the present invention, it should be clear to those skilled in the art that further embodiments may be made without departing from the scope of the present invention.

What is claimed is:

1. A ratchet screwdriver comprising:

a mounting seat having a receiving space defined in a front side thereof, a first slot and a second slot defined in an inside of the receiving space, the first and second slots located symmetrically in opposite directions to each other, a passage defined through the mounting seat, a reception hole defined in a wall of the mounting seat, a block extending from an outside of the mounting seat and located in opposite to the reception hole; wherein a first limit portion with an inclined face being defined on a lateral side of the first slot, a second limit portion with an inclined face being defined on a lateral side of the second slot, the first and second limit portions being located symmetrically in opposite directions to each other;

a driving shaft having a ratchet portion which is located in the receiving space, the ratchet portion having multiple teeth, a section extending from a rear end of the driving shaft and rotatably inserted through the passage, a groove defined in an outer periphery of the rear end of the driving shaft and located beyond the mounting seat, a working end formed on a front end of the driving shaft and adapted to be connected with a driving member, an annular slot defined in the outer periphery of the driving shaft;

two pawls respectively located in the first and second slots, wherein each pawl having a first lateral portion and a second lateral portion, and having opposite a left lateral side and a right lateral side, a middle portion of a right lateral side of each pawl having an engaging portion with multiple teeth for engaging with the teeth of the ratchet portion; the second lateral portion of each pawl having a contact portion, the contact portions of the pawls contacting with the first and second limit portions respectively;

two springs respectively located in the first and second slots and providing a force to pivot the two pawls to engage with the ratchet portion by their teeth respectively;

a control member rotatably mounted to the mounting seat and having a mounting hole defined therethrough and the driving shaft rotatably extending through the mounting hole, two control plates extending from an inner periphery of the mounting hole; an inner side of the control member having multiple positioning slots;

wherein when the control member is rotated clockwise, one control plate drives one pawl in the second slot to depart from the ratchet portion, so that the driving shaft is freely rotated counter clockwise relative to the mounting seat; wherein when the control member is rotated counter clockwise, the other control plate drives the other pawl in the first slot to depart from the ratchet portion, so that the driving shaft is freely rotated clockwise relative to the mounting seat; the control member having a restriction slot defined therein, the block being movable in the restriction slot, wherein when the block contacts one end of the restriction slot, one control plate remove one pawl in the first slot from the ratchet portion, wherein when the block contacts the other end of the restriction slot, the other control plate remove the other pawl in the second slot from the ratchet portion;

a bead axially and movably located in the reception hole;

a positioning spring located in the reception hole and biasing the bead outward to be engaged with one of the multiple positioning slots respectively, so as to position the control member at a first position where the driving shaft is freely rotated counter clockwise relative to the mounting seat, a second position where the driving shaft cannot rotate freely relative to the mounting seat, and a third position where the driving shaft is freely rotated clockwise relative to the mounting seat;

a C-clip engaged with the groove of the driving shaft and restricting the driving shaft from being separated from the front side of the mounting seat, and a clipping member engaged with the annular slot of the driving shaft to restrict the control member from being separated from the front side of the mounting seat.

2. The ratchet screwdriver as claimed in claim 1, wherein the working end of the driving shaft has a polygonal recess.

3. The ratchet screwdriver as claimed in claim 1, wherein the working end of the driving shaft has a polygonal rod.

4. The ratchet screwdriver as claimed in claim 1, wherein a receiving hole is defined at a front end of the receiving space, and the receiving hole has a larger diameter than that of the receiving space, the first slot has a first hole defined in an inner portion thereof, the second slot has a second hole defined in an inner portion thereof; a fixing ring connected to the front side of the mounting seat and fixedly mounted in the receiving hole, and having a through hole and two apertures; the first lateral portion of each pawl having a cylindrical pivot with two ends protruding a front end and a rear end of each pawl, the pivots of the pawls in the first and second slots being respectively pivotably inserted into the first and second holes and two apertures so that the pawls are rotatable respectively to engage with the teeth of the ratchet portion by their teeth respectively.

5. The ratchet screwdriver as claimed in claim 4, wherein the inner periphery of the through hole is shaped by a connection of a bigger half circular hole and a smaller half circular hole; the driving shaft rotatably extends through the receiving space, the passage, the smaller half circular hole of the through hole and the mounting hole, a distal portion of each control plate inserts into the bigger half circular hole respectively.

6. The ratchet screwdriver as claimed in claim 4, wherein the fixing ring has a protrusion, a side of an inner wall of the receiving hole is defined a recessed arc fixing hole, the protrusion is engaged with the fixing hole.

7. The ratchet screwdriver as claimed in claim 1, wherein a middle portion of a left lateral side of each pawl has a circular recessed connecting portion, one spring in the first slot is biased between an inside of the first slot and the recessed connecting portion of one pawl corresponding thereto, and the other spring in the second slot is biased between an inside of the second slot and the recessed connecting portion of the other pawl corresponding thereto.

8. The ratchet screwdriver as claimed in claim 1, wherein the number of the multiple is three.

9. The ratchet screwdriver as claimed in claim 1, wherein an end portion of a rear side of the mounting seat is for connecting with a handle.

10. The ratchet screwdriver as claimed in claim 1, wherein opposite a first arc protrusion and a second arc protrusion are defined in the inside of the receiving space and have same diameter smaller than that of the receiving space.

11. The ratchet screwdriver as claimed in claim 1, wherein the first arc protrusion has a distal end directing to the front side of the mounting seat.

* * * * *